United States Patent [19]

Blakey

[11] 3,963,820

[45] June 15, 1976

[54] COATED SUBSTRATES PRODUCTION

[75] Inventor: Rene C. Blakey, Preston, England

[73] Assignee: Star Paper Limited, Feniscowles, Blackburn, England

[22] Filed: Jan. 9, 1975

[21] Appl. No.: 539,684

Related U.S. Application Data

[63] Continuation-in-part of Ser. No. 337,239, March 1, 1973, abandoned.

[52] U.S. Cl. ..... 264/134; 264/284; 427/365; 427/366; 427/375; 427/382

[51] Int. Cl.[2] ..... B29D 9/02

[58] Field of Search ..... 264/134, 284; 427/365, 427/366, 375, 382

[56] References Cited

UNITED STATES PATENTS

| | | | |
|---|---|---|---|
| 2,554,662 | 5/1951 | Cowgill | 117/65 |
| 2,627,088 | 2/1953 | Alles | 264/134 |
| 2,819,179 | 1/1958 | Barnard | 427/366 X |
| 2,867,263 | 1/1959 | Bartlett | 264/284 X |
| 3,113,888 | 12/1963 | Gold | 117/71 |
| 3,200,005 | 8/1965 | Bauer | 427/375 X |
| 3,278,322 | 10/1966 | Harkins | 427/365 X |
| 3,359,352 | 12/1967 | Powell | 264/134 X |
| 3,732,348 | 5/1973 | Ignell | 264/134 |
| 3,853,594 | 12/1974 | Moroff | 427/366 X |
| 3,911,180 | 10/1975 | Ozaki | 427/366 X |

*Primary Examiner*—Richard R. Kucia

*Attorney, Agent, or Firm*—Lawrence Rosen; E. Janet Berry

[57] ABSTRACT

A process is described in which a cast coated high gloss polymeric coating is formed on a sheet substrate by applying an aqueous emulsion or dispersion of polymeric material to the substrate, forming a continuous film of the polymeric material in the presence of water by heating without pressure to a temperature above the film forming temperature of the polymeric material, and moulding the film under high pressure at a temperature greater than 100°C. The process is capable of being operated in such a manner as to give a high gloss coating that has a gloss and smoothness as good as or better than that obtainable by cast coating of mineral pigment.

11 Claims, 1 Drawing Figure

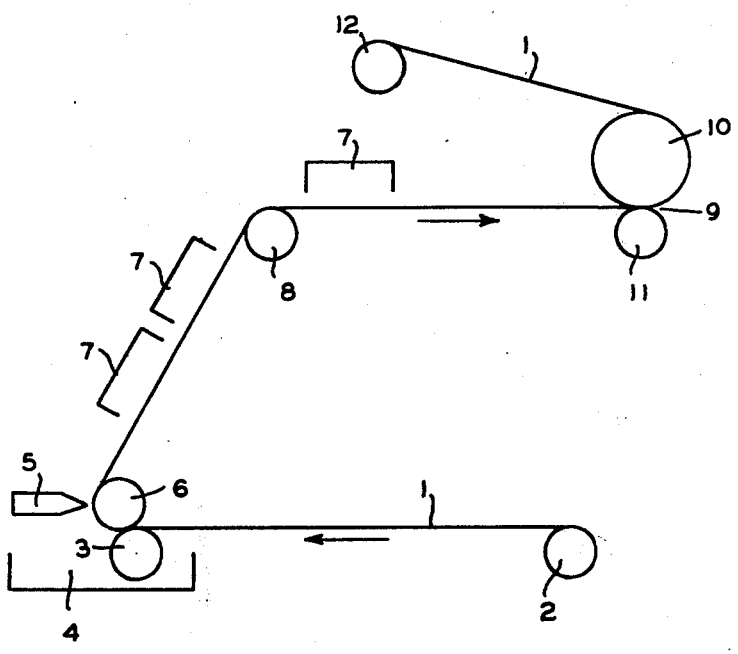
12
1
10
7
9
7
8
11
7
5
6
1
3
4
2

COATED SUBSTRATES PRODUCTION

This application is a continuation-in-part of my application Ser. No. 337,239, filed Mar. 1, 1973, now abandoned.

Sheet substrates, especially paper and paperboard, may have a pigment composition applied by a process known as cast coating to give a surface which has exceptional flatness and smoothness and a mirror-like gloss and which is readily recognisable as a cast coated finish. The coating used for such methods normally has over 70% by weight of mineral pigment which is bound with a mixture of synthetic polymer and a film forming substance of animal or vegetable origin. The high finish of these products makes them ideal for use where prestige presentation or customer appeal is required, for example, as booklet covers or display packaging. Their disadvantage, however, is that the surface is easily scratched and scuffed and also is easily soiled and stained during use. There is therefore a need for a coating having the finish of conventional cast coated products but which is far superior in respect of scuffing and staining.

Polymeric coatings, that is to say coatings consisting mainly (e.g. more than 90%, and usually more than 95% by weight) of synthetic polymeric material, can be designed to give improved resistance to scuffing and staining but usual methods of applying polymeric coatings to paper and board are incapable of achieving the same gloss and smoothness characteristics of pigment cast coated products. For example in a process where a melt is extruded onto the substrate and solidified onto it the polymer takes up the roughness and uneveness of the underlying substrate. Similar results are obtained when paper or paperboard is coated with a solvent solution of polymer. A worse situation occurs when aqueous dispersions or emulsions of polymer are applied since the water swells the cellulose fibres in the substrate causing extreme roughness. Calendering of the dried, rough, product is incapable of giving any satisfactory improvement.

Polymeric coating or lamination of a polymeric film onto, for instance, a paper or paperboard substrate cannot easily be conducted to give a high gloss unless a pigment cast coated substrate is used. The resultant gloss may then approach the original finish of the cast coated product but this double processing is expensive and often the resultant product still contains blemishes due to small particles of dust or air bubbles or uneven application of coating or adhesive.

The cast coating method used for applying pigment compositions are wholly inoperable when polymeric materials are applied.

Methods are known in which an aqueous dispersion or emulsion of polymeric material is applied to a substrate and the coated substrate is subsequently processed in a similar manner to that used for cast coating of mineral based compositions. However these methods are either extremely slow to carry out in practice or else result in damage to most, if not all, cellulose based substrates.

One method is typified by that described in U.S. Pat. No. 3,113,888. In this the substrate is coated with aqueous composition and while still fluid is brought into contact with a large polished cylinder heated at a temperature of 80° to 99°C and the coating is maintained in contact with the polished surface without application of external pressure and without any relative movement between the coating and the surface, as the drum rotates through, for example, three quarters of its circumference. In this method the nip formed by the wet coating on the substrate and the heated cylinder is usually a controlled gap but it is essential that no significant pressure is applied at this point otherwise the aqueous emulsion would be squeezed off the substrate.

As the heated cylinder and the substrate move slowly together the coating forms into a film and, provided the substrate is permeable, dries. A rate controlling factor in this process is that the substrate and the cylinder must be maintained in contact for a long time in order to give the polymeric material an opportunity to form into a film, to allow the film to acquire the configuration of the polished surface and to allow adequate drying. In a typical process the optimum speed of travel of the substrate is 25 meters per minute and the cylinder is 3.7 meters in diameter. The process could, in theory, be conducted more quickly if the roll was heated to a temperature above 100°C but this is impossible because as the temperature approaches this level there is a danger of causing bubbles in the coating due to boiling of the water or of building up vapour between the coating and the cylinder resulting in uncast areas.

In another method typified in U.S. Pat. No. 2,554,662 an aqueous emulsion is selected such that upon drying it does not form a continuous film on the substrate. The emulsion is applied, the coating is dried an is then fused to form a continuous film by application of heat, and is then subjected to a hot pressure moulding operation which gives a smooth and glossy finish. In this method the fusing step is conducted in such a way that it results in almost complete loss of water from the substrate and the drying and moulding conditions described can cause permanent embrittlement of substrates such as paper or paperboard. They can also cause the product to develop objectionable curling tendencies as moisture is regained by the substrate after processing. The heat treatment also makes the process slow and expensive. Furthermore low coat weights are generally necessary and these are unlikely to provide the high finish required or affect the desired protective action of the polymeric coating.

In general it is particularly difficult to obtain high gloss coatings on permeable substrates (such as paper and paperboard) since they tend to be rougher than impermeable substrates (such as metal foils) and more susceptible to damage by the processing conditions.

It has been our object to devise a continuous method of forming a cast coated high gloss moulded polymeric coating on a permeable sheet substrate which can be operated very much faster than any of the known methods that are available for this and which, with appropriate selection of polymeric materials, is capable of giving the very smooth coating and high gloss coating exemplified by cast coating but which does not suffer from the disadvantages of cast coatings of pigments.

According to the invention such a method comprises the following sequential steps (a) applying to the substrate an aqueous coating comprising an aqueous an aqueous emulsion or dispersion of a polymeric material having a second order transition temperature below 40°C, (b) heating the aqueous coating without application of pressure to a temperature above the film-forming temperature of the polymeric material by passage through a drying zone, and thereby forming a continuous film of the evaporating water until the moisture content of the coated substrate is from 8 to 18%, based on the weight of substrate, (c) moulding the film by passing the coated substrate having a moisture content of 8 to 18% through a nip between a pressure roll exerting a moulding pressure above 10 kg/cm$^2$ and a heated polished moulding cylinder wtih the film in contact with the moulding cylinder, the moulding cylinder having a moulding temperature which is between 105° and 150°C and at which the polymeric material has a viscosity of 40 to 80 units, and maintaining the film in contact with the moulding cylinder without any relative movement between the film and the cylinder while the cyinder moves through 45° to 270°, and (d) separating the substrate carrying the resultant high gloss moulded polymeric coating from the cylinder.

Thus in the invention we heat the aqueous coating to form a continuous film and to evaporate some but not all of the water before effecting any moulding, and it is then possible to mould at high pressure and high temperature to obtain a surface having a mirror like finish. As a result of the high temperature and pressure the moulding, and therefore the whole process, can be operated very much quicker than was possible previously. Typical speeds are greater than 40 meters, and often 60, meters per minute. Thus, in a typical example, the substrate can travel at 70 meters per minute, compared to 25 meters per minute in a typical prior process. Also, when the moulding surface is a roll, this roll can be very much smaller than was previously necessary, for example it can be a third of the diameter of the roll that was previously used. This is a great saving economically as chromium plated or other highly polished moulding surfaces are extremely expensive to produce and maintain.

A further advantage of using a combination of high temperature and pressure is that small pin holes due to imperfections in coating, for example small bubbles of foam, can be moulded out to give a completely continuous coating. It should also be noted that the process is capable of operating in a pressure range which is not sufficient to markedly affect rigidity and other desirable properties of cellulosic substrates for packaging applications.

It is easily possible to carry out the process in such a way as to yield a product having a finish that has such a high gloss that it would be recognised as a cast coating. For instance the ratio of reflected light to incident light at an angle of 75°can be greater than 85%.

The process of the invention is best carried out continuously by applying the coating continuously onto the substrate, passing the coated substrate continuously through a drying zone and then effecting moulding by passing the coated substrate through a pressure nip formed by a resilient roll and a heated polished moulding cylinder, with the film in contact with the moulding cylinder.

Such an apparatus is illustrated diagrammatically in the accompanying drawing. In this a sheet substrate 1 is taken off a supply roll 2 and is passed over an applicator roll 3 that dips into a pan 4 of the aqueous emulsion or dispersion that is being applied. The thickness of the coating applied is regulated by an air knife 5. The substrate carrying the wet coating passes around guide roll 6 and into a heating zone in which it is heated by heaters 7. While passing through this zone the coating is heated to a temperature above the film forming temperature, so that the polymer forms a film and after formation further water is generally evaporated.

After passing around guide roll 8 the substrate, that now carries a continuous film of the polymeric material, enters the nip 9 between a polished roll 10 that serves as a moulding surface and that is heated at a temperature above 100°C and a pressure roll 11. Finally the coated substrate is wound onto take up roll 12 or may be passed directly into a cutting device to convert the product into sheets for subsequent use.

Any convenient system of applying the emulsion or dispersion can be used. For example instead of metering the coating (by the air knife) after it has been applied the coating may be metered initially, for example by having a double roll applicator system by which a metered amount of coating composition is put onto the roll 3. The applied composition generally has 40–60% solids content and the pick up is generally 5 to 30, e.g. 10 to 25 grams, dry weight per square meter.

In the heating zone the coating may be heated by any suitable system of heating, for example by infra-red heaters or by a hot air oven. There may be a forced draft through part or all of the heating zone in order to increase the rate of evaporation.

The moulding surface will be a surface that has the desired configuration for the moulded coating. Generally the moulding surface is smooth so that the final coating is smooth. However if desired it may be embossed. Generally it is of polished chromium, usually being chromium plated, but may be, for example, of polished nickel.

The moulding roller will be heated by any convenient means, for example super heated steam, to the temperature of at least 105°C. The maximum temperature attainable by the roller 10 is usually determined by practical difficulties but usually there is little advantage in operating at temperatures greater than 150°C. The preferred temperature range is usually from 110° to 125°C. Naturally the temperature will be chosen having regard to the materials in the film being moulded.

The pressure roll may be any roll that is capable of forcing the substrate against the moulding roll. It may be of substantially non-resilient material, for example steel, or it may be of resilient material, for example a steel roll covered by a coating of, for example, rubber or felt. It must be capable of exerting a significant pressure. Thus whereas in the prior processes moulding has been operated at a negligible pressure, for example normally less than 1 kg/cm$^2$, in this process the pressure will always be at least 10 kg/cm$^2$. Best results are generally obtained at pressures in excess of 25 kg/cm$^2$. The maximum pressure in any particular process is determined primarily by practical considerations. If, as is generally preferred, the resiliency of the nip and the thickness of the substrate is such that the nip is, for example, from 2 to 3 centimeters wide then it is usually unnecessary to have pressures in excess of 50 kg/cm$^2$.

Many different permeable substrates can be coated by the invention, including paper and paperboard. The minimum weight of paper coated in the invention is usually about 40 grams per square meter and the maximum weight of paperboard is usually about 400 grams per square meter. Thus for example it can be considered that papers weigh from 40 to 200 grams per square meter and boards from 200 to 400 grams per square meter. A preferred weight for use in the invention is from 80 to 400 grams per square meter. The paper or paperboard is preferably of cellulose fibres but may be of synthetic fibres or of mixtures of synthetic fibres and cellulose fibres. If synthetic fibres are used they will generally have to be chosen of a material such that they do not melt during the moulding. The substrate may be precoated, prior to the coating with polymer, and such precoats are those commonly encountered in paper-making practice and may be pigmented or non-pigmented. These pre-coatings are employed when necessary to reduce roughness of the fibrous substrate or to assist in reducing the rate at which water is lost from the polymer emulsion or dispersion prior to forming a continuous film.

As a result of the substrate being moist as it enters the nip 9, i.e. immediately before the moulding, the substrate itself is more resilient and thus allows better conformation to the moulding surface 10. Thus the coated substrate should still contain at least 8% and most preferably 12% by weight water based on the weight of substrate, as it enters the nip 9. However the substrate should not contain too much water as otherwise the vapour pressure that is built up in the nip may be so great as to damage the substrate or the film. Generally therefore the coated substrate does not contain more than 18% and most preferably not more than 15% by weight water based on the weight of substrate. Although the polymer film will inevitably have a lower percentage moisture content than the substrate it will inevitably still contain some moisture, and this is valuable in the subsequent moulding step since the evaporation of this moisture results in a change in the tackiness of the film during moulding and facilitates release of the moulded film from the moulding cylinder.

Most at least of the moisture in the coated substrate as it enters the nip 9 evaporates and escapes from the substrate as soon as it can after leaving the nip. There should be no relative movement between the coated surface and the moulding surface and best results are obtained if the coated surface moves in contact with the moulding cylinder while this evaporation occurs until the coated product is dried to a stable moisture content; in general this occurs while the cylinder rotates through 45° to 270°. Thus, for example, substrates containing cellulose normally contain from 5 to 8% moisture and so preferably the coated surface is maintained in contact with the moulding surface until such a moisture content is attained.

A wide variety of polymeric materials may be coated in accordance with the invention provided they meet two criteria. The first is that they must have a second order transition temperature of below 40°C. By choosing such polymeric materials one ensures that it is possible to form a continuous film in the presence of water merely by heating the aqueous coating in the heating zone. In theory it might be expected that it would be adequate to define the polymer as having a film forming temperature well below 100°C. Film formation is, however, a rate process such that if water is removed rapidly, as occurs on porous substrates, the temperature of film formation will be effectively increased. Film forming temperature therefore depends upon the particular process in which the film is being formed. An absolute value that can be used to indicate the temperature at which a film will be formed is the second order transition temperature.

The second criteria of the polymeric material is that at the moulding temperature it must have a viscosity of 40 to 80 units (as defined below), and most preferably of 50 to 70 units.

In the invention "moulding" does not involve mere flattening under pressure against a smooth surface. Instead, the material must truly be moulded. Thus the material of the film must flow and conform closely to the surface, it must therefore be of a material that does, to some extent, wet the surface, but if it wets the surface too much it will adhere to the surface too strongly and will not be released from the surface. Accordingly it is necessary to strike a compromise between the polymeric material sticking to the surface and conforming inadequately to the surface. The use of polymeric materials having the stated viscosity at the moulding temperature permits this. The units used in this specification and in the claims when referring to viscosity are the units obtained when the viscosity is measured by a shearing disc viscometer, having a rotor head of 1.5 inch conforming to the American Society of Testing Materials Method No. D927-52T. A typical well known viscometer of this type is a Mooney viscometer and thus these units are obtained by a Mooney viscometer.

Polymeric materials that can be used in the invention can be selected from a wide variety of materials, for example polyvinyl acetate, polyvinylidene chloride, copolymers of vinyl chloride and vinyl acetate, polystyrene copolymers, polyurethanes, polyacrylates, polymethacrylates, polyacrylonitriles, polyamides and polyethylenes. However in general we find that it is best that the polymeric material is one that should have been made by an emulsion or dispersion polymerisation reaction as we find that there is often rather too much surfactant present in proprietary emulsions or dispersions of materials, such as polyamide and polyethylene, that have been made by some other polymerisation and then dispersed into water.

Although an advantage of the invention is that commercially available aqueous emulsions or dispersions can be used we find that for best results, and especially for the production of a surface finish as good as a cast coat finish of mineral coating composition, most commercially available materials do not have the desired viscosity and thus do not fulfil the moulding requirements in respect of achieving the correct degree of adhesion to the heated moulding surface so that the coating will conform closely to this surface and take on its high finish. A modifying agent often has to be included and suitable agents are tack reducing agents (if the material is too tacky at the moulding temperature) and tack increasing agents if the material is not tacky enough at the moulding temperature. Thus with many proprietary polymeric emulsion or dispersions we find it desirable to include a minor proportion, for example less than 30% based on the dry weight of the main polymer, of a tack reducing agent. The optimum amount depends upon the particular tack reducing agent and polymeric material being used. For example sodium carboxy methyl cellulose, methyl cellulose, polyvinyl alcohol and polyvinyl pyrrolidone may be used in amounts of up to 10% based on the weight of the main polymer while sodium alginate may be used in amounts of up to 2% based on the weight of the main polymer. Other materials that can be used include emulsions of wax, polyethylene and stearates. Similarly with other polymeric emulsions and dispersions we find similar amounts of tack increasing agents are desirable; for instance as shown in Example 8 below acrylic copolymers can be included for this purpose.

While all these tack reducing and increasing agents allow processing of the polymeric materials and give the product a smooth and glossy finish we also find that many polymeric materials that give a high gloss by the process of the invention tend to be rather softer than is desirable in a commercial finish. In most cases therefore we prefer to include materials which both reduce or increase the tack and increase hardness of the moulded polymeric coating. We find certain acrylic copolymers are particularly useful as tack reducing agents in a variety of polymeric materials, for example for butadiene methyl methacrylate copolymers (for example materials sold under the trade name Butakon) and styrene acrylic copolymers (for example materials sold under the trade name Revertex), in that they both improve the appearance and increase hardness. A suitable acrylic tack releasing agent is sold under the trade name "Amberlac" A165 by Rohm and Hass U.K. Limited, this being an ammonium salt and being non-film forming in character. Another suitable tack reducing agent, that is of particular value when the main polymeric material is a sytrene acrylic copolymer, is styrene maleic anhydride copolymer, for example the material sold by Arco Chemical Company as SMA Resin, which may be dissolved in ammonium hydroxide to form a solution which will give a continuous film on drying.

Because of the desirability for the final surface generally to be hard the polymeric material will often have a second order transition temperature above minus 10°C.

The substrate can be a plain substrate and the coating may be clear or may contain a small amount of pigment for decorative or functional purposes. However the invention is of particular value when used for applying a clear high gloss coating to a printed surface, for example paper or paperboard carrying a print of, for example, a wood grain effect or of a photograph. Thus postcards can be made by the invention by printing the desired pictures on card, applying a clear glaze by the method of the invention and then cutting the substrate to size.

Other additives may be included in the coating mixture to improve processing or functional characteristics, these including foam inhibiting agents, viscosity modifiers, plasticisers, coalescing solvents and release agents. The use of much materials give optimum operation and end use flexibility. The coatings may also include a minor proportion of inorganic pigment, organic pigment, dyestuff, metallic pigment, nacreous pigment, matting agent, and so forth, or mixtures of such materials, to give a wide range of decorative plastic coatings. Similarly, materials that are absorbent to ultra-violet light may be incorporated into clear coatings to give a product with excellent resistance to discolouration when exposed to sunlight.

The following are some examples.

EXAMPLE 1

15 grams (dry weight) per square meter of a mixture consisting of an aqueous emulsion containing 100 dry parts of butadiene-methyl methacrylate copolymer having a second order transition temperature of minus 21°C sold under the trade name "Butakon" ML 501, and 180 parts water, and 20 dry parts of an ammonium salt of an acrylic copolymer sold under the trade name Amberlac A165 were applied to a substrate of 300 grams per square meter woodfree paperboard. The coated substrate was passed through a drying zone in which the air temperature was 110°C for 5 seconds and was then moulded at 130°C and 35 kg/cm² against a highly polished chromium plated roll, using the apparatus as illustrated in the drawing. The final product had a smooth high gloss coating at least equal to that produced by cast coating of mineral coating composition.

EXAMPLE 2

15 grams dry weight per square meter of a mixture consisting of an aqueous emulsion containing 100 dry parts of styrene-acrylic copolymer having a second order transition temperature of 28°C, sold under the trade name "Revertex" A309, and 160 parts water, and 20 dry parts of an ammoniacal solution of low molecular weight stryene-maleic anhydride copolymer sold under the trade name SMA Resin 144OH, were applied to a substrate of 240 grams per square meter woodfree paperboard. The coated substrate was then heated in a heating zone at which the air had a temperature of 120°C for 4 seconds and was then moulded at a pressure of 35 kg/cm² and a temperature of 105°C in the apparatus illustrated in the accompanying drawing. The product had a smooth high gloss surface.

EXAMPLE 3

The process of Example 1 was repeated except that a harder butadiene-methylmethacrylate copolymer, with a second order transition temperature of minus 11°C and which is available commercially under the trade name Butakon ML577/1, and a moulding temperature of 125°C was used. The product had a smooth high gloss coating.

EXAMPLE 4

The process of Example 2 was repeated except that a harder styrene-acrylic copolymer, with a second order transition temperature of 19°C and which is available commercially under the trade name Revertex A386, was used and was moulded at 110°C and 40 kg/cm² to give a smooth high gloss coating.

The products from Examples 1 and 3 give a softer surface at room temperature than those from Examples 2 and 4 whereas the latter materials are very fluid at high temperature and result in a low moulding temperature. Mixtures of the copolymers can therefore be used to advantage as shown in Example 5.

EXAMPLE 5

A combination of 70 dry parts of butadiene methyl methacrylate copolymer emulsion, sold under the trade name of Butakon ML577/1, 30 dry parts of styrene-acrylic copolymer emulsion, sold under the trade name of Revertex A386, 20 dry parts of an ammonium salt of an acrylic copolymer, sold under the trade name of Amberlac A165, and water to give a final solids content of 40% is partly dried as in Example 1 and moulded at 120°C at 40 kg/cm². The product has all the visual characteristics of conventional cast coated products and the surface is hard and free from blocking tendencies.

EXAMPLE 6

A mixture was formed of 100 dry parts of a commercially available aqueous emulsion described as "Polyurethane Dispersion CA7524" (from Farbenfabriken Bayer AG) and known to form a film below 20°C with 180 parts of water and 10 parts of low molecular weight styrene maleic anhydride copolymer was formed. This composition was applied at 12 grams dry weight per square meter to a substrate comprising 80 grams per square meter of woodfree paper with 10 grams per square meter of a pigmented coating on each side. The coated substrate was passed through a drying zone in which the air temperature was 100°C for 6 seconds and was taken moulded at 120°C and 50 kg/cm² against a higly polished chromium plated roll, using the apparatus as illustrated in the drawing. The smooth and high gloss surface had good resistance to abrasion.

Polystyrene has a second order transition temperature over 100°C and thus the emulsions do not form a film according to the requirements of this invention. The film forming temperature can however be reduced by incorporating a plasticiser as shown in Example 7.

EXAMPLE 7

A composition is formed of 100 dry parts of polystyrene emulsion available under the trade name Vinamul 7700; 20 parts of dibutyl phthalate plasticiser, and 10 dry parts of an ammonium salt of an acrylic copolymer, and sold under the trade name of Amberlac A165. This can be coated, dried and moulded at the rates, temperatures and pressures given in Example 2 to give a smooth high gloss product.

Polyvinylidene chloride and its copolymers are usually low in tack and do not adhere sufficiently to the heated moulding surface. In this case it is necessary to add a material which can increase the adhesion to the moulding surface so that it takes on the high finish, as shown in Example 8.

EXAMPLE 8

A composition is formed of 100 dry parts of a polyvinylidene copolymer available under the trade name of IXAN WA50 (from Solvay et Cie) and 10 dry parts of an acrylic copolymer dispersion available under the trade name Primal WS-24. This may be coated, dried and moulded at the rates, temperatures and pressures given in Example 2 to give a smooth high gloss product.

I claim:

1. A continuous process for making a cast coated high gloss moulded polymeric coating on a permeable sheet substrate selected from the group consisting of paper and paperboard, which comprises the following sequential steps (a) applying to the substrate an aqueous coating comprising an aqueous emulsion or dispersion of a polymeric material having a second order transition temperature below 40°C selected from the group consisting of polyvinyl acetate, polyvinylidene chloride, copolymers of vinyl chloride and vinyl acetate, polystyrene copolymers, polyurethanes, polyacrylates, polymethacrylates, polyacrylonitriles, polyamides and polyethylene, (b) heating the aqueous coating without application of pressure to a temperature above the film-forming temperature of the polymeric material by passage through a drying zone, and thereby forming a continuous film of the polymeric material in the presence of water and subsequently evaporating water until the moisture content of the coated substrate is from 8 to 18%, based on the weight of substrate, (c) moulding the film by passing the coated substrate having a moisture content of 8 to 18% through a nip between a pressure roll exerting a moulding pressure above 10 kg/cm² and a heated polished moulding cylinder with the film in contact with the moulding cylinder, the moulding cylinder having a moulding temperature which is between 105° and 150°C and at which the polymeric material has a viscosity of 40 to 80 Mooney viscosity units, and maintaining the film in contact with the moulding cylinder without any relative movement between the film and the cylinder while the cylinder moves through 45° to 270°C and (d) separating the substrate carrying the resultant high gloss moulded polymeric coating from the cylinder.

2. A process according to claim 1 in which the moulding surface is a chromium plated roll.

3. A process according to claim 1 in which the polymeric material is styrene acrylic copolymers.

4. A process according to claim 1 in which the polymeric material is a butadienemethyl methacrylate copolymer.

5. A process according to claim 1 in which the emulsion or dispersion includes a minor proportion of a tack reducing agent.

6. A process according to claim 1 in which the emulsion or dispersion includes a minor proportion of an acrylic copolymer as a tack reducing agent.

7. A process according to claim 1 in which the polymeric material is mainly a styrene acrylic copolymer and includes a minor amount of a styrene maleic anhydride copolymer as a tack reducing agent.

8. A process according to claim 1 in which the emulsion or dispersion includes a tack increasing agent.

9. A process according to claim 1 in which the moulding pressure is 25 to 50 kg/cm².

10. A process according to claim 1 in which the temperature during moulding is from 110° to 125°C.

11. A process according to claim 1 in which the coating weight of the polymeric material is from 10 to 30 grams per square meter.

* * * * *